US010413460B2

(12) United States Patent
Itano

(10) Patent No.: US 10,413,460 B2
(45) Date of Patent: Sep. 17, 2019

(54) WHEELCHAIR

(71) Applicant: SWANY CORPORATION, Kagawa (JP)

(72) Inventor: Tsukasa Itano, Higashikagawa (JP)

(73) Assignee: SWANY CORPORATION, Kagawa (JP)

( * ) Notice: Subject to any disclaimer, the term of this patent is extended or adjusted under 35 U.S.C. 154(b) by 127 days.

(21) Appl. No.: 15/666,782

(22) Filed: Aug. 2, 2017

(65) Prior Publication Data

US 2018/0042795 A1 Feb. 15, 2018

(30) Foreign Application Priority Data

Aug. 9, 2016 (JP) ..... 2016-156407

(51) Int. Cl.
*A61G 5/08* (2006.01)

(52) U.S. Cl.
CPC ..... *A61G 5/0825* (2016.11)

(58) Field of Classification Search
CPC ..... A61G 5/0825; A61G 5/0816
See application file for complete search history.

(56) References Cited

U.S. PATENT DOCUMENTS 2,810,429 A * 10/1957 Lane ..... A61G 5/08 297/44
2,914,111 A * 11/1959 Mize ..... A61G 5/08 297/45
3,321,239 A * 5/1967 Cosper ..... A61G 5/00 297/423.26
4,045,051 A * 8/1977 Igarashi ..... A61G 5/08 280/42
4,371,183 A * 2/1983 Dion ..... A61G 5/08 280/250.1
5,188,383 A * 2/1993 Thompson ..... A61G 5/08 280/250.1
5,328,183 A * 7/1994 Counts ..... A61G 5/08 280/250.1
5,496,050 A * 3/1996 Geiger ..... A61G 5/08 280/250.1
5,857,688 A * 1/1999 Swearingen ..... A61G 5/08 280/250.1

(Continued)

FOREIGN PATENT DOCUMENTS

WO 2007/007811 1/2007

*Primary Examiner* — Joseph M Rocca
*Assistant Examiner* — Michael R Stabley
(74) *Attorney, Agent, or Firm* — Wenderoth, Lind & Ponack, L.L.P.

(57) ABSTRACT

A wheelchair is provided which includes link rods that intersect each other in an X shape, and are pivotably coupled to each other by a pivot shaft. The link rods include a rod central part, and rod upper and lower parts. The rod central parts hold the pivot shaft. The rod upper and lower parts and slant from first and second inclined parts on the both ends of the rod central part in opposite directions with respect to the rod central part. When the X-link portion is folded, the rod central parts overlap each other and are aligned in one straight line in the vertical orientation, and frame accommodation space portions which can accommodate the middle frame portions are provided on the both sides of the rod central parts.

4 Claims, 12 Drawing Sheets

(56) References Cited

U.S. PATENT DOCUMENTS

| | | | | |
|---|---|---|---|---|
| 6,135,222 | A * | 10/2000 | Furukawa | A61G 5/043 180/11 |
| 6,910,543 | B2 * | 6/2005 | Kanno | A61G 5/045 180/19.3 |
| 7,246,821 | B2 * | 7/2007 | Sato | A61G 5/08 280/793 |
| 7,360,781 | B2 * | 4/2008 | Schreiber | A61G 5/08 280/250.1 |
| 7,384,058 | B2 * | 6/2008 | Munsey | A61G 5/08 280/642 |
| 7,562,896 | B2 * | 7/2009 | Murayama | A61G 5/08 280/47.38 |
| 8,454,048 | B1 * | 6/2013 | Regan | A61G 5/08 280/649 |
| 8,590,920 | B2 * | 11/2013 | Masaki | A61G 5/08 280/650 |
| 8,628,108 | B2 * | 1/2014 | Gingras | A61G 5/08 280/42 |
| 8,998,245 | B1 * | 4/2015 | Anooshian | A61G 5/08 280/649 |
| 9,592,169 | B2 * | 3/2017 | Eddy | A61G 5/101 |
| 2005/0057021 | A1 * | 3/2005 | Miyoshi | A61G 5/00 280/657 |
| 2006/0087103 | A1 * | 4/2006 | Schreiber | A61G 5/08 280/649 |
| 2008/0084084 | A1 * | 4/2008 | Hsieh | A61G 5/08 296/65.04 |
| 2008/0106059 | A1 * | 5/2008 | Jacobs | A61G 5/08 280/250.1 |
| 2016/0106606 | A1 * | 4/2016 | Eddy | A61G 5/101 280/250.1 |

* cited by examiner

WHEELCHAIR

CROSS-REFERENCE TO RELATED APPLICATIONS

The present application claims priority under 35 U. S. C. § 119 to Japanese Patent Application No. 2016-156,407, filed on Aug. 9, 2016. The contents of this application are incorporated herein by reference in their entirety.

BACKGROUND OF THE INVENTION

1. Field of the Invention

The present invention relates to a foldable wheelchair.

2. Description of the Related Art

A wheelchair shown in FIG. 10 is known which can be folded by moving right and left side frames 101 toward each other. The both side frames 101 of the known wheelchair are coupled to each other by X-link portions 121. The X-link portions 121 make the wheelchair foldable.

Each of the X-link portions 121 of the wheelchair shown in FIG. 10 includes a pair of link rods 122. The link rods 122 intersect each other in their central parts. The link rods 122 are rotably coupled by a pivot shaft to each other at the intersection 133 of the link rods 122. The lower ends of the each of the link rods 122 are swingably coupled to bottom frame portions 111 of the side frame 101 by pivot shafts. The upper ends of each of the link rods 122 are coupled to seat frames 106. A flexible seat 107 is coupled to the seat frames 106, which is coupled to the upper ends of the link rods 122. When the wheelchair is unfolded, the both side frames 101 are moved away from each other so that the upper ends of the link rods 122 are moved away from each other. As a result, the flexible seat 107 can be held under tension whereby forming a seat 105 which can support the wheelchair user. When the wheelchair is folded, the both side frames are moved toward each other, and the link rods 122 of the X-link portion 121 pivot so that the upper and lower ends of the link rods 122 are moved toward each other. As a result, the wheelchair can be folded.

The present applicant has been developed a wheelchair which can have a reduced width and be compactly stored when the wheelchair is folded by moving its both side frames toward each other (see International Publication No. WO 2007/007,811). FIG. 11 is a front view showing the wheelchair when unfolded. FIG. 12 is a front view showing the wheelchair shown in FIG. 11 when folded by moving its both side frames 201 toward each other. In the wheelchair shown in FIGS. 11 and 12, the central parts of link rods 222 of each of X-link portions 221 are curved. In the wheelchair of FIG. 12, when the both side frames 201 are moved toward each other, the seat frames 207 and the upper and lower ends of the X-link portions 221 are positioned on the interior side of the side frames 201. According to this arrangement, the width of the folded wheelchair can be small.

In the wheelchair shown in FIG. 12, when the X-link portions 221 are folded, the space on the both sides of the link rods 222 at the intersection 233 is reduced by the curved link rods 222. The illustrated wheelchair includes middle frames 215 which are arranged on the both sides of the intersection 233 of the link rods 222. If the side frames 201 are arranged too close to each other, the middle frames 215 will contact the link rods 222, and the movement of the middle frames 215 or the link rods 222 may be restricted. In other words, when the wheelchair is folded by moving the side frames 201 toward each other, the size reduction in the width direction of the wheelchair is limited by the curved link rods 222.

The present invention is devised to solve the above problem. It is one object of the present invention to provide a wheelchair which has a further reduced width when folded by moving its side frames toward each other, and can be more compactly stored.

SUMMARY OF THE INVENTION

To achieve the above object, a wheelchair includes driving wheels, a pair of side frames, a folding linkage, a pair of seat frames, and a flexible seat sheet. The side frames rotatably support the driving wheels which are coupled to the exterior sides of the side frames. The folding linkage foldably interlinks the side frames with each other so that the wheelchair can be folded by moving the side frames toward each other. The seat frames are coupled to the upper ends of the folding linkage. The both sides of flexible seat sheet are coupled to the seat frames. The folding linkage includes a pair of link rods that intersect each other in an X shape whereby forming an X-link portion. The link rods are pivotably coupled to each other by a pivot shaft. Each of the side frames includes a bottom frame portion, and a middle frame portion. The bottom frame portion extends in the horizontal direction. The lower end of the link rod is coupled to the bottom frame portion so that the link rod can swing about the lower end of the link rod. The middle frame portion is arranged above the bottom frame portion parallel to the bottom frame portion. Each of the link rods includes a rod central part, and rod upper and lower parts. The rod central parts of the link rods hold the pivot shaft. The rod upper and lower parts extend from first and second inclined parts on the both ends of the rod central part, respectively. The rod upper and lower parts slant from the first and second inclined parts in opposite directions with respect to the rod central parts. The upper end of the rod upper part is coupled to the seat frame. The lower end of the rod lower part is coupled to the bottom frame portion, and the bottom frame portion swingably supports the link rod. When the X-link portion is folded, the rod central parts overlap each other and are aligned in the vertical orientation, and frame accommodation space portions which can accommodate the middle frame portions are provided on the both sides of the rod central parts in the vertical orientation and between the rod upper and lower parts, which slant in opposite directions with respect to the rod central parts.

According to this wheelchair, the width of the wheelchair can be reduced when the wheelchair is folded by moving the both side frames guided by the folding linkage toward each other. The reason is that when the X-link portion is folded, frame accommodation space portions which can accommodate the middle frame portions are provided on the both sides of the rod central parts of the link rods in the vertical position and between the rod upper and lower parts, which form the X-link portion of the folding linkage. According to the wheelchair, since the middle frame portions can be accommodated in the frame accommodation space portions, the middle frames will not contact the link rods so that interference between the middle frames and the link rods can be avoided when the wheelchair is folded. As a result, the middle frame portions can be positioned closer to the center of the wheelchair. Since the middle frame portions can be positioned closer to the center of the wheelchair, the width of the folded wheelchair can be reduced.

Also, according to this arrangement which provides the frame accommodation space portions, the flexibility of designing a wheelchair can be enhanced. The reason is that, according to the aforementioned wheelchair, as long as the middle frame portions are positioned on the sides of the rod central parts in the vertical orientation, even if the relative height between the middle frame portion and the link rod is changed, the middle frame portions can be arranged closer to the center to a certain degree. That is, even in the case where any of the length of the link rods, the height of the middle frame portions, and the width of the seat is changed, the wheelchair is compactly folded without changing other dimensions as long as the middle frame portions are positioned within the frame accommodation space portions, in other words, as long as the middle frame portions contact neither the rod upper parts nor the rod lower parts.

In addition, in a wheelchair according to a second aspect of the present invention, the rod upper part includes an upper-side extension section, and an upper-side transition section. The upper end of the upper-side extension section is coupled to the seat frame. The upper-side transition section extends between the upper-side transition section and the upper end of the rod central part. The upper-side transition section slants toward the exterior side of the wheelchair from the first inclined part, which is arranged in the transition part between the rod central part and the upper-side transition section so that the upper end of the upper-side transition section is positioned on the exterior side relative to the lower end of the upper-side transition section when the X-link portion is folded. The upper-side extension section slants from a third inclined part which is arranged in the transition part between the upper-side transition section and the upper-side extension section so that the upper-side extension section extends substantially parallel to the rod central part. Sheet accommodation space which can accommodate the seat sheet in a loose state is provided between the upper-side extension sections that face each other when the X-link portion is folded.

According to this wheelchair, the sheet accommodation space is provided between the upper-side extension sections of the link rods that face each other when the X-link portion is folded. Accordingly, when the X-link portion is folded, the seat sheet does not interfere with the folding motion of the X-link portion. As a result, the wheelchair can be compactly folded.

In addition, in a wheelchair according to a third aspect of the present invention, when the X-link portion is folded, the upper-side extension sections face each other and extend parallel to each other in the vertical direction, and the sheet accommodation space is provided between the link rods.

According to this wheelchair, since the upper-side extension sections that face each other extend parallel to each other and in the vertical direction when the X-link portion is folded, the sheet accommodation space is provided between the link rods so that the rod upper parts do not diverge toward the top side of the wheelchair. Therefore, the width of the wheelchair can be reduced.

In addition, in a wheelchair according to a fourth aspect of the present invention, the rod lower part has a straight shape, and slants toward the exterior side of the wheelchair from the second inclined part, which is arranged in the transition part between the rod central part and the rod lower part, so that the lower end of rod lower parts is positioned on the exterior side relative to the upper end of the rod lower parts when the X-link is folded.

According to this wheelchair, since the rod lower part has a straight shape, the shape of the link rod can be simple. Therefore, the link rod can be easily designed and manufactured.

In addition, in a wheelchair according to a fifth aspect of the present invention, the rod lower part includes a lower-side extension section, and a lower-side transition section. The lower end of the lower-side extension section is coupled to the bottom frame portion. The lower-side transition section extends between the lower-side extension section and the lower end of the rod central part. The lower-side transition section slants toward the exterior side of the wheelchair from the second inclined part, which is arranged in the transition part between the rod central part and the lower-side transition section, so that the lower end of the lower-side transition section is positioned on the exterior side relative to the upper end of the lower-side transition section when the X-link is folded. The lower-side extension section slants from a fourth inclined part which is arranged in the transition part between the lower-side transition section and the lower-side extension section so that the lower-side extension section extends substantially parallel to the rod central part. The lower side extension portions face each other and extend parallel to each other in the vertical direction when the X-link portion is folded.

According to this wheelchair, when the X-link portion is folded so that the side frames are positioned close to each other, the lower-side extension sections of the rod lower parts can be brought in the vertical position and positioned close to each other. According to this arrangement, since the lower-side extension sections of the link rods can vertically extend, loads that are applied to the link rods can be applied vertically downward to the bottom frame portions. For this reason, when the wheelchair is folded, the bottom frame portions can surely support the loads from the X-link portion, and can avoid moving the side frames toward the exterior sides due to the weight of the X-link portion. As a result, the wheelchair can be stably held folded.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Figure 1:
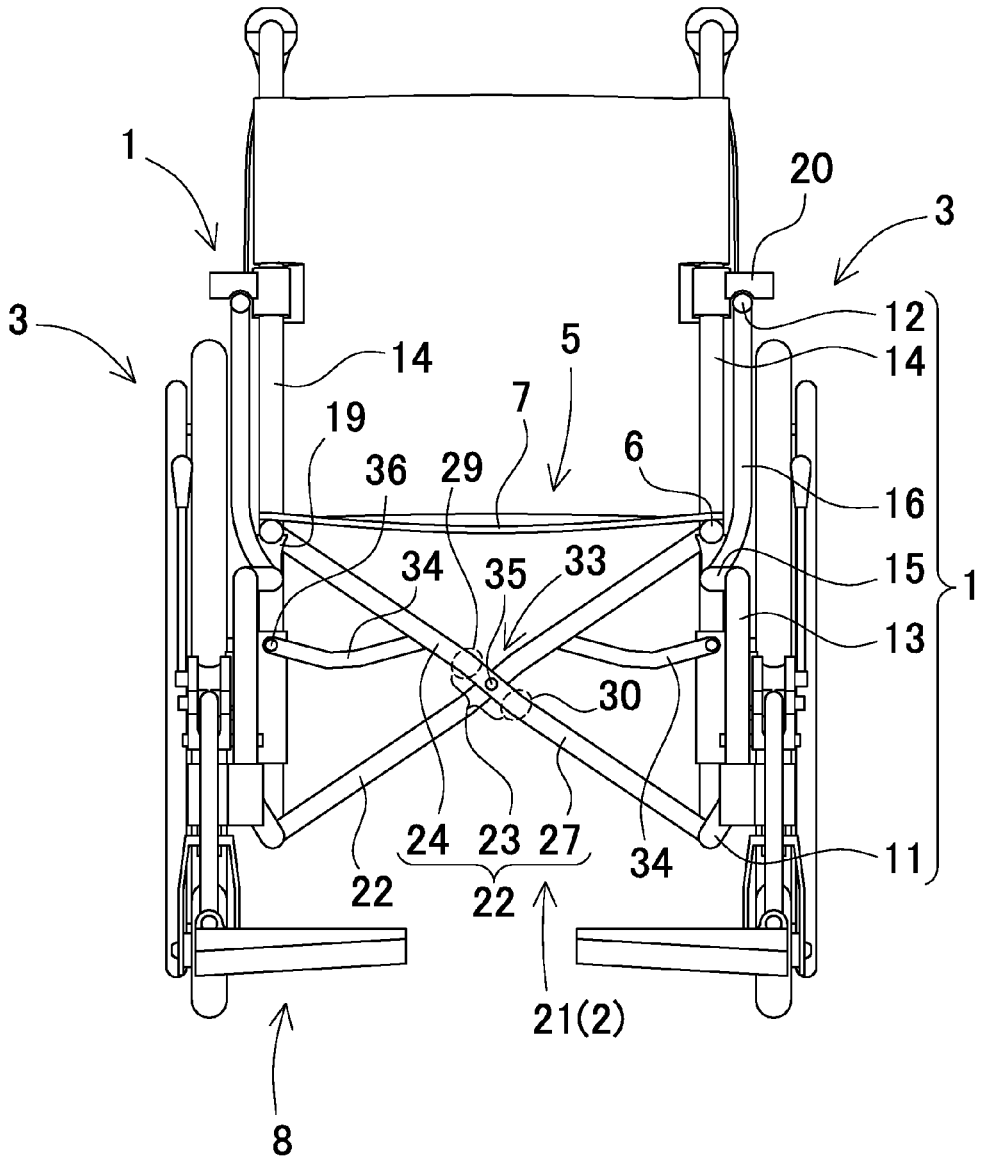
FIG. 1 is a front view of a wheelchair according to an embodiment of the present invention.

The embodiments will now be described with reference to the accompanying drawings, wherein like reference numerals designate corresponding or identical elements throughout the various drawings.

It should be appreciated, however, that the embodiments described below are illustrations of a wheelchair used therein to give a concrete form to technical ideas of the invention, and a wheelchair of the invention is not specifically limited to description below. In this specification, it should be appreciated that the members shown in claims attached hereto are not specifically limited to members in the embodiments.

Also, it should be noted that although the terms "horizontal(ly)" and "vertical(ly)" are used in the specification and claims, these terms are not always intended to strictly mean the horizontal and vertical directions, but include substantially horizontal and vertical directions which slightly slant from the horizontal and vertical directions.

Figure 2:
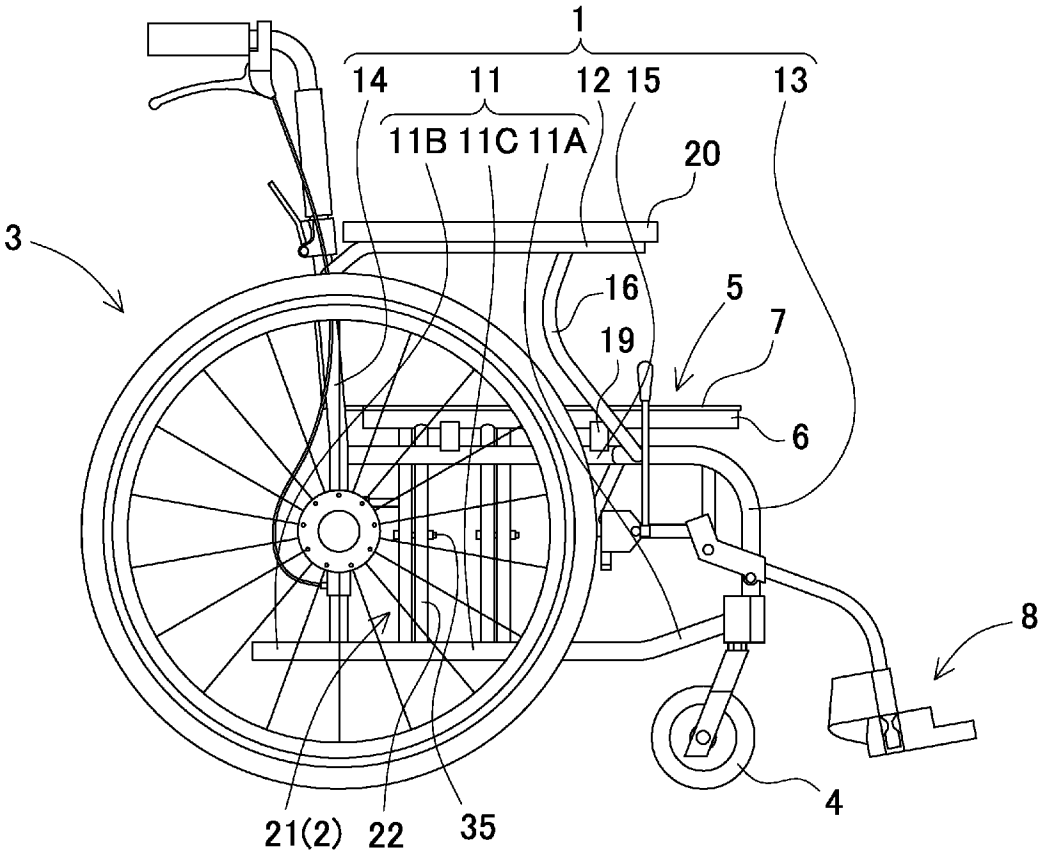
FIG. 2 is a side view of the wheelchair shown in FIG. 1.
Figure 3:
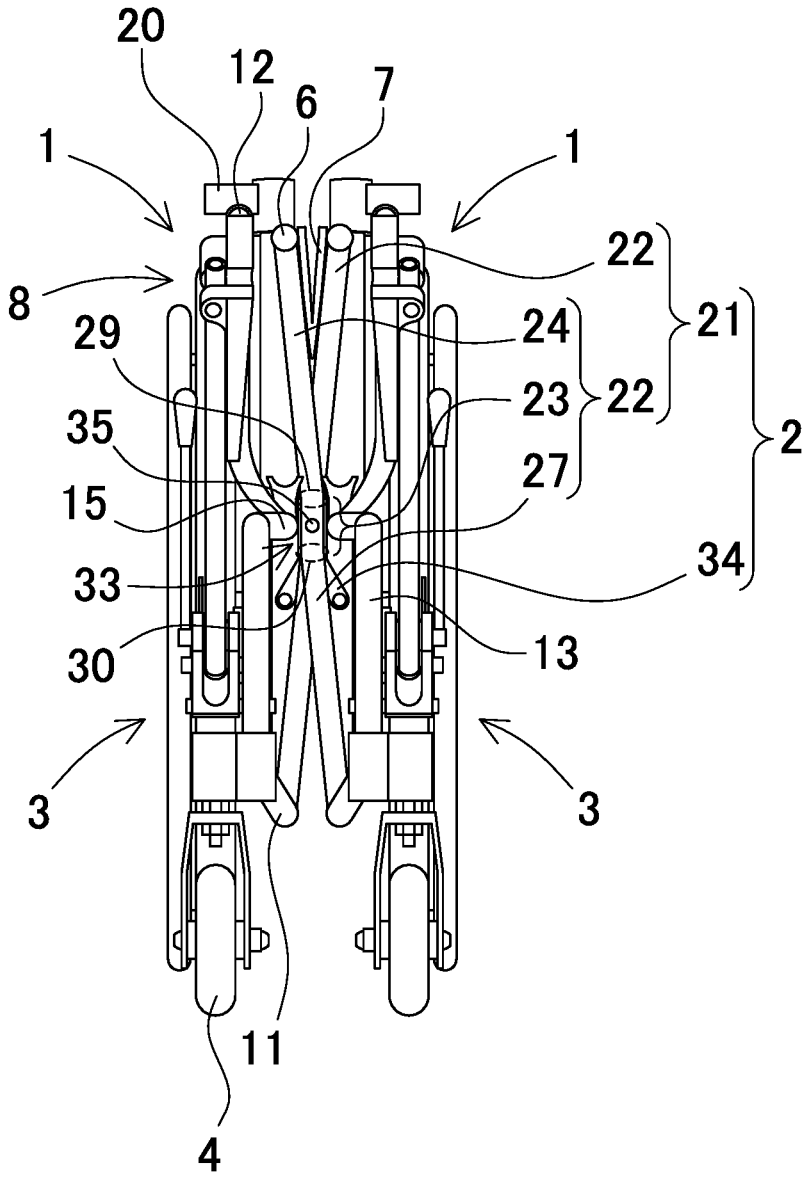
FIG. 3 is a front view showing the wheelchair shown in FIG. 1 when folded.
Figure 4:
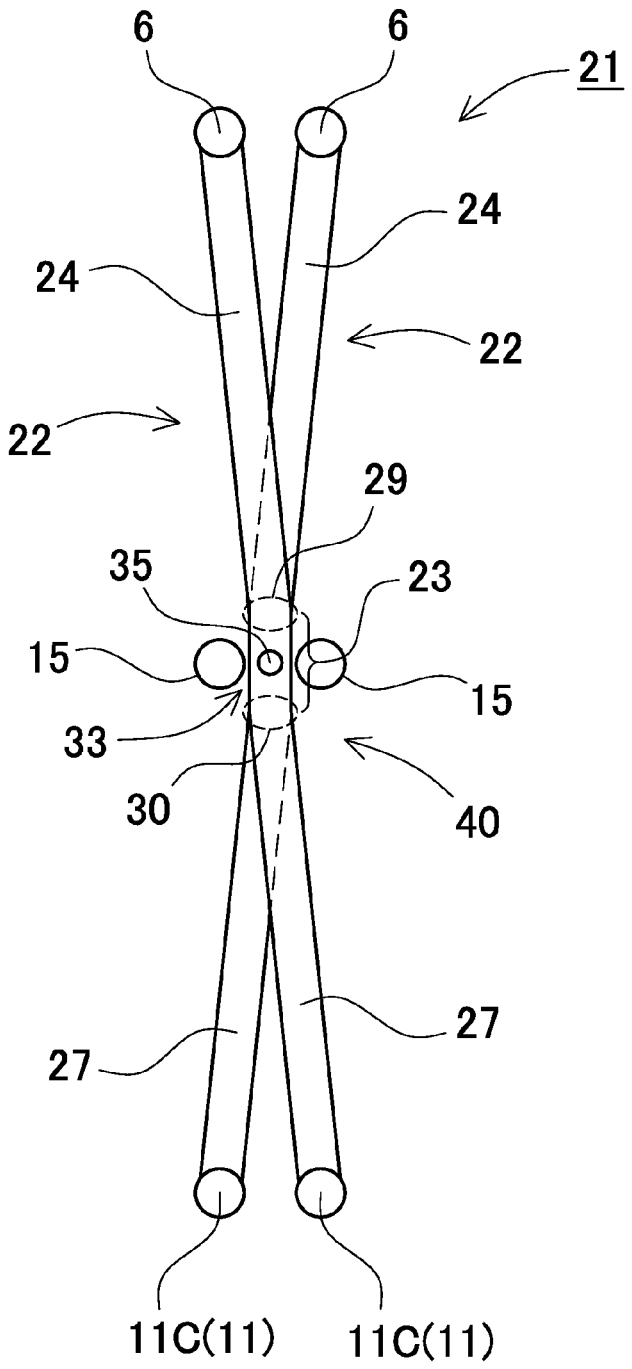
FIG. 4 is a front view of an X-link portion according to the embodiment of the present invention.

A wheelchair according to an embodiment of the present invention is shown in FIGS. 1 to 4. FIG. 1 shows a front view of the wheelchair. FIG. 2 shows a side view of the wheelchair shown in FIG. 1. FIG. 3 shows a front view showing the folded wheelchair shown in FIG. 1. FIG. 4 shows a front view of an X-link portion of the wheelchair shown in FIG. 3.

The illustrated wheelchair includes driving wheels 3, a pair of side frames 1, a folding linkage 2, seat frames 6, a flexible seat 7, casters 4, and footrests 8. The driving wheels 3 are coupled to the exterior sides of the side frames 1. The folding linkage 2 interlinks the pair of side frames 1 with each other. The seat frames 6 are coupled to the top ends of the folding linkage 2. The both sides of the flexible seat 7 are coupled to the seat frames 6 of the folding linkage 2. The casters 4 are coupled to the front parts of the side frames 1, and are free to swivel in the horizontal direction. The footrests 8 are coupled to the side frames 1.

The side frames 1 of the illustrated wheelchair are foldably coupled to each other by the folding linkage 2. The driving wheels 3 are coupled to the side frames 1. As shown in FIGS. 1 and 3, the upper ends of the folding linkage 2 are coupled to the seat frames 6, and the lower ends of the folding linkage 2 are coupled to the bottom frame portions 11. The right and left side frames 1 can be used as a single frame by interlinking the side frames 1 with each other by the folding linkage 2. The width of the wheelchair body can be reduced by folding the folding linkage 2 by moving the right and left side frames 1 toward each other as shown in FIG. 3. The flexible seat 7, which is coupled to the seat frames 6 of the folding linkage 2, can be held under tension whereby forming a seat 5 by moving the right and left side frames 1 away from each other.

(Side Frames 1)

Each of the side frames 1 includes an elbow rest frame portion 12, a vertical frame portion 14, a bottom frame portion 11, a middle frame portion 15, a front frame portion 13, and an interlinking frame portion 16. The elbow rest frame portion 12 extends in the horizontal direction. An elbow rest 20 is arranged on the upper surface of the elbow rest frame portion 12. The vertical frame portion 14 is coupled to the rear end part of the elbow rest frame portion 12. The bottom frame portion 11 extends in the horizontal direction, and is coupled to the lower end part of the vertical frame portion 14. The middle frame portion 15 is arranged at midpoint between the elbow rest frame portion 12 and the bottom frame portion 11. The front frame portion 13 is formed by bending the front part of the middle frame portion 15 and couples the front lower end of the middle frame portion 15 to the bottom frame portion 11. The interlinking frame portion 16 interlinks the front end part of the middle frame portion 15 with the front end part of the elbow rest frame portion 12. These frame portions of the side frame 1 of the illustrated wheelchair are formed from metal pipes. The metal pipes are coupled to each other by welding, or the like, whereby forming the side frame 1.

(Middle Frame Portion 15)

As shown in FIG. 2, the middle frame portion 15 extends in the horizontal direction between the bottom frame portion 11 and the elbow rest frame portion 12. The front end of the middle frame portion 15 is coupled to the upper end of the front frame portion 13. In the illustrated side frame 1, the front frame portion 13 is formed by bending one pipe so that the front frame portion 13 is arranged on the front end of the middle frame portion 15.

The illustrated middle frame portions 15 can support the seat frames 6 which are arranged above the illustrated middle frame portions 15 when the wheelchair is unfolded. The frame support portions 19 are arranged on the upper part of the middle frame portion 15 shown in FIGS. 1 and 2. The seat frames 6 are supported by the frame support portions 19 when the wheelchair is unfolded.

(Bottom Frame Portion 11)

The bottom frame portion 11 shown in FIG. 2 includes a frame rear end part 11B, a front rear end part 11A, and a frame central part 11C. The frame rear end part 11B is arranged on the rear side of the wheelchair. The bottom end of the vertical frame portion 14 is coupled to the frame rear end part 11B. The front rear end part 11A is arranged on the front rear side of the wheelchair. The bottom end of the front frame portion 13 is coupled to the frame front end part 11A. The frame central part 11C extends between the frame rear end part 11B and the frame front end part. The frame central parts 11C are coupled to the lower ends of the folding linkage 2. The frame central part 11C can rotate about the axis of the bottom frame portion 11. As a result, the folding linkage 2 can pivot about the bottom frame portion 11.

(Seat Frame 6)

As shown in FIG. 1, the middle frame portions 15 of the aforementioned side frames 1 can support the seat frames 6 which are arranged above the illustrated middle frame portions 15 when the wheelchair is unfolded. The seat sheet 7, which is a flexible sheet, is arranged between the seat frames 6 on the both sides. The flexible seat 7 can be held under tension and serves as the seat 5 between the side frames 1 when the wheelchair is unfolded.

(Folding Linkage 2)

The wheelchair can be folded by the folding linkage 2 when the side frames 1 are moved toward each other as shown in FIG. 3. The wheelchair can be unfolded by the folding linkage 2 when the side frames 1 are moved away from each other as shown in FIG. 1. As shown in FIGS. 1 to 3, the folding linkage 2 can include front-side and rear-side X-link portions 21. The X-link portion 21 includes two link rods 22. The two link rods 22 are coupled to the side frames 1. A pair of sublinks 34 is provided for the both side frames 1. Each of the sublinks 34 interlinks the middle area of the upper part of the link rod 22 with the side frame 1.

(X-Link Portion 21)

FIG. 4 shows the front view of the X-link portion 21 when the side frames 1 are moved toward each other. The two link rods 22 of the X-link portion 21 are arranged in an X shape, and are coupled to each other by a rotation part so that they can rotate about the rotation part in a vertical plane. In the wheelchair shown in FIG. 1, a rotation shaft 35 serves as the rotation part. However, the rotation part is not limited to the rotation shaft. Any structure that allows the link rods 22 to pivot relative to each other in the vertical plane can be used as the rotation part.

(Link Rod 22)

The link rod 22 includes a central part which can be defined by inclined parts. In this specification, the term "inclined" part refers not only to an inclined or slanting part but also to a curved or bent part. As shown in FIG. 4, the link rod 22 includes a rod upper part 24, a rod lower part 27, and a rod central part 23. The rod upper part 24 is arranged in the upper part of the link rod 22. The rod upper part 24 is coupled to the seat frame 6. The rod lower part 27 is arranged in the lower part of the link rod 22. The rod lower part 27 is coupled to the bottom frame portion 11. The rod central part 23 extends between the rod upper part 24 and the rod lower part 27. One link rod 22 intersects another link rod 22 in the rod central part 23. The link rods 22 can pivot about the rotation shaft 35 relative to each other at the intersection 33. The rod upper and lower parts 24 and 28 of the link rod 22 extend from first and second inclined parts 29 and 30 on the both ends of the rod central part. The rod upper and lower parts 24 and 28 slant from the first and second inclined parts 29 and 30 in opposite directions with respect to the rod central parts.

The rod upper part 24 has a straight shape. The upper end of the rod upper part 24 is coupled to the seat frame 6. The lower end of the rod upper part 24 is connected to the upper end of the rod central part 23. The first inclined part 29 serves as the boundary transition part between the rod upper part 24 and the rod central part 23. That is, the boundary transition part as the first inclined part 29 between the rod central part 23 and the rod upper part 24 is inclined so that the upper end of the rod upper part 24 is positioned on the exterior side of the wheelchair with respect to the rod central part.

The rod lower part 27 has a straight shape. The lower end of the rod lower part 27 is coupled to the frame central part 11C of the bottom frame portion 11. The upper end of the rod lower part 27 is connected to the lower end of the rod central part 23. The second inclined part 30 serves as the boundary transition part between the rod lower part 27 and the rod central part 23. The boundary transition part as the second inclined part 30 between the rod central part 23 and the rod lower part 27 is inclined so that the lower end of the rod lower part 27 is positioned on the exterior side of the wheelchair with respect to the rod central part.

As shown in FIG. 4, when the wheelchair is folded by moving the side frames 1 toward each other, the rod central part 23 of the of link rods 22 of the X-link portion 21 overlap each other and extend in the vertical direction. When the X-link portion 21 is folded, frame accommodation space portions 40 are provided on the both sides of the rod central parts 23 that overlaps each other in the vertical position, and between the rod upper and lower parts 24 and 27, which slant with respect to the rod central parts 23. The frame accommodation space portions 40 can accommodate the middle frame portions 15. The frame accommodation space portion 40 is formed in the area between the rod upper part 24 of one link rod 22 and the rod lower part 27 of another link rod 22 of the illustrated X-link portion 21.

(Frame Accommodation Space Portion 40)

Figure 11:
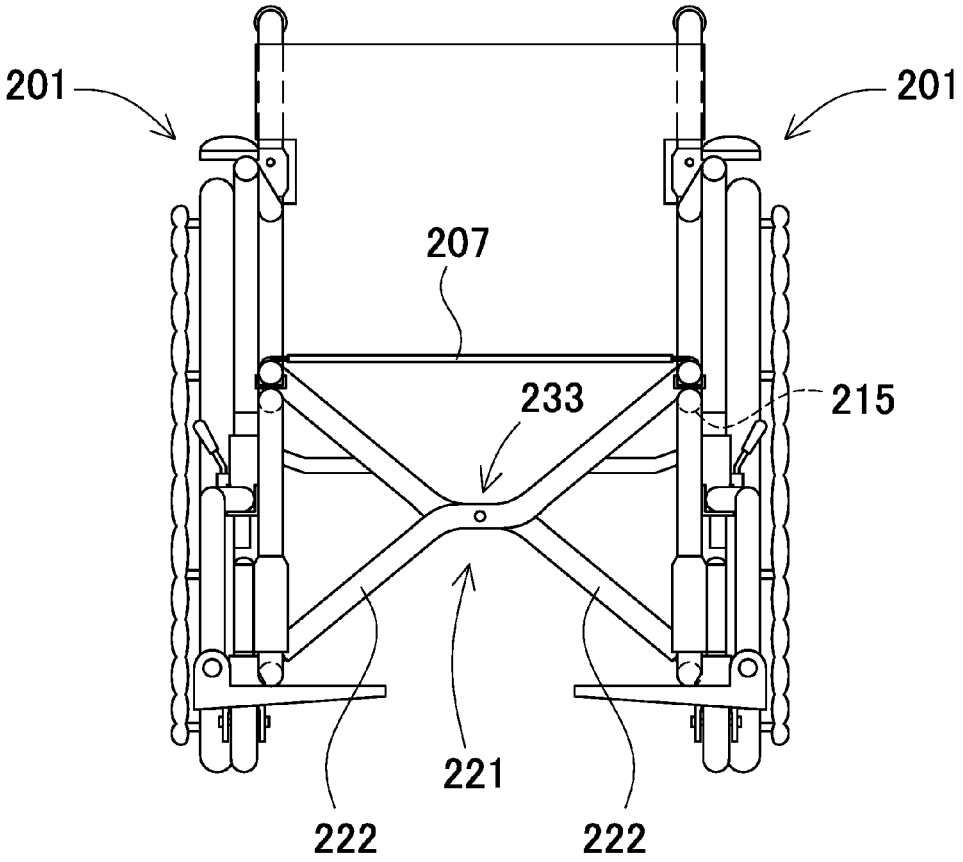
FIG. 11 PRIOR ART
FIG. 11 is a perspective view showing a wheelchair which has been developed by the inventor of the present invention.
Figure 12:
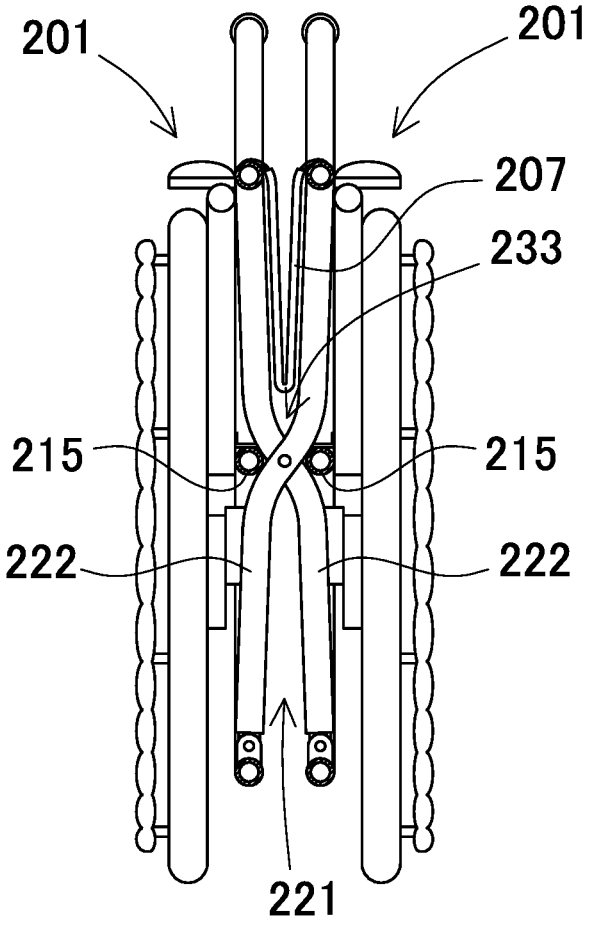
FIG. 12 PRIOR ART
FIG. 12 is a front view showing the wheelchair shown in FIG. 11 when folded.

When the wheelchair is folded by moving the side frames 1 toward each other, the middle frame portions 15 of the side frames 1 are accommodated in the frame accommodation space portions 40. The link rods 22 have the inclined structure. As a result, the X-link portion 21 provides the frame accommodation space portions 40 when the wheelchair is folded. Therefore, the middle frame portions 15 can be positioned closer to the center of the wheelchair. Contrary to this, in the X-link portion 221 of the wheelchair disclosed in WO2007/007,811 shown in FIGS. 11 and 12, the central parts of the link rods 222 are inclined with respect to the vertical direction when the wheelchair is folded. For this reason, the areas on the both sides of the intersection 233 of the link rods 222 are reduced by the inclined central parts of the link rods 222. When the side frames 201 are moved toward the center of the wheelchair, the middle frame portions 215 will contact the link rods 222. As a result, the gap between the side frame 201 and the inclined central part of the link rod 222 is limited. Consequently, when the wheelchair is folded, the side frames 201 cannot be positioned sufficiently close to each other, that is, the width of the wheelchair will be large. According to the wheelchair of the first embodiment, the link rods 22 of the X-link portion 21 are inclined from the upper and lower ends of the rod central parts 23 so that the rod central parts 23 stand upright when the wheelchair is folded. As a result, the frame accommodation space portions 40 can be provided on the both sides of the rod central parts 23. Consequently, the middle frame portions 15 can be positioned closer to the center of the wheelchair as compared with the known wheelchair. The reason is that the movement of the side frames 1 toward each other is not obstructed until the middle frame portions 15 contact the rod central parts 23 that extend in the vertical direction. Therefore, according to the wheelchair of the first embodiment, since the side frames 1 which face each other can be positioned closer to the center of the wheelchair than the known wheelchair, the width of the wheelchair can be reduced when the wheelchair is folded as compared with the known wheelchair.

In the wheelchair shown in FIG. 3, the length of the rod central part 23 of the link rod 22 is dimensioned longer than the outer diameter of the middle frame portion 15. That is, the size in the height direction of the frame accommodation space portion 40 is sufficient to accommodate the middle frame portion 15. For example, the length of the rod central part 23 can be not smaller than double and preferably triple as much as the outer diameter of the middle frame portion 15. In this case, the flexibility of designing a wheelchair can be enhanced. For example, in the case where the width of the unfolded wheelchair is designed large, the length of the X-link portion 21, which interlinks the side frames 1 with each other, will be large. In the case where the length of the X-link portion 21 is increased, the length from the end to the central part of the link rod 22 will be increased. Accordingly, in this case, when the wheelchair is folded, the intersection 33 of the X-link portion 21 will be positioned higher than the case of the wheelchair shown in FIG. 3. As a result, the position of the frame accommodation space portions 40, which are provided on the sides of the intersection 33, will be high. In other words, the relative positions between the middle frame portion 15 and the frame accommodation space portion 40 will be shifted in the vertical direction. Even in this case, if the length of the rod central part 23 of the link rod 22 is dimensioned larger so that the size in the vertical direction of the frame accommodation space portion 40 is dimensioned large, the middle frame portion 15 can be accommodated in the frame accommodation space portion 40 when the wheelchair is folded.

(Rotation Shaft 35)

In the wheelchair shown in FIGS. 1 and 3, the rod central parts 23 are coupled to each other by the rotating shaft 35 so that the link rods 22 of the X-link portion 21 can pivot relative to each other. According to this arrangement, the link rods 22 of the X-link portion 21 can pivot in both directions that increase and reduce the interval between the ends of the link rods 22.

(Sublink 34)

The sublinks 34 interlink the X-link portion 21 with the side frames 1, and can hold the side frames 1 in the vertical orientation. The right and left sublinks 34 are coupled to the illustrated X-link portion 21 of the folding linkage 2 that is arranged on the rear side. More specifically, the right and left sublinks 34 interlink the link rods 22, which compose the X-link portion 21, with the side frames 1. One end of the illustrated sublink 34 is coupled to the middle of the rod upper part 24 of the link rod 22 of the X-link portion 21 so that the link rod 22 of the X-link portion 21 can rotate in a vertical plane about the rotation shaft 35. Another end of the sublink 34 is swingably coupled to the side frame 1. More specifically, in the illustrated wheelchair, another end of the sublink 34 is coupled to the central part of the vertical frame portion 14 by a pin 36 so that the sublink 34 can swing in a vertical plane. The sublinks 34 allow the side frames 1 to move toward or away from each other while keeping them in their vertical orientation. Since the illustrated folding linkage 2 includes the pair of sublinks 34, which are arranged on the right and left sides, the right and left side frames 1 can be stably held in their vertical orientation when the wheelchair is unfolded.

The wheelchair of the first embodiment has been described. In the wheelchair according to the first embodiment, the rod upper and lower parts 24 and 27 of the link rod 22 of the X-link portion 21 are inclined from the boundary transition parts between the rod central part 23, and the rod upper and lower parts 24 and 27. The following description will describe a wheelchair according to a second embodiment which includes link rods with a shape different from the wheelchair according to the first embodiment.

Second Embodiment

Figure 5:
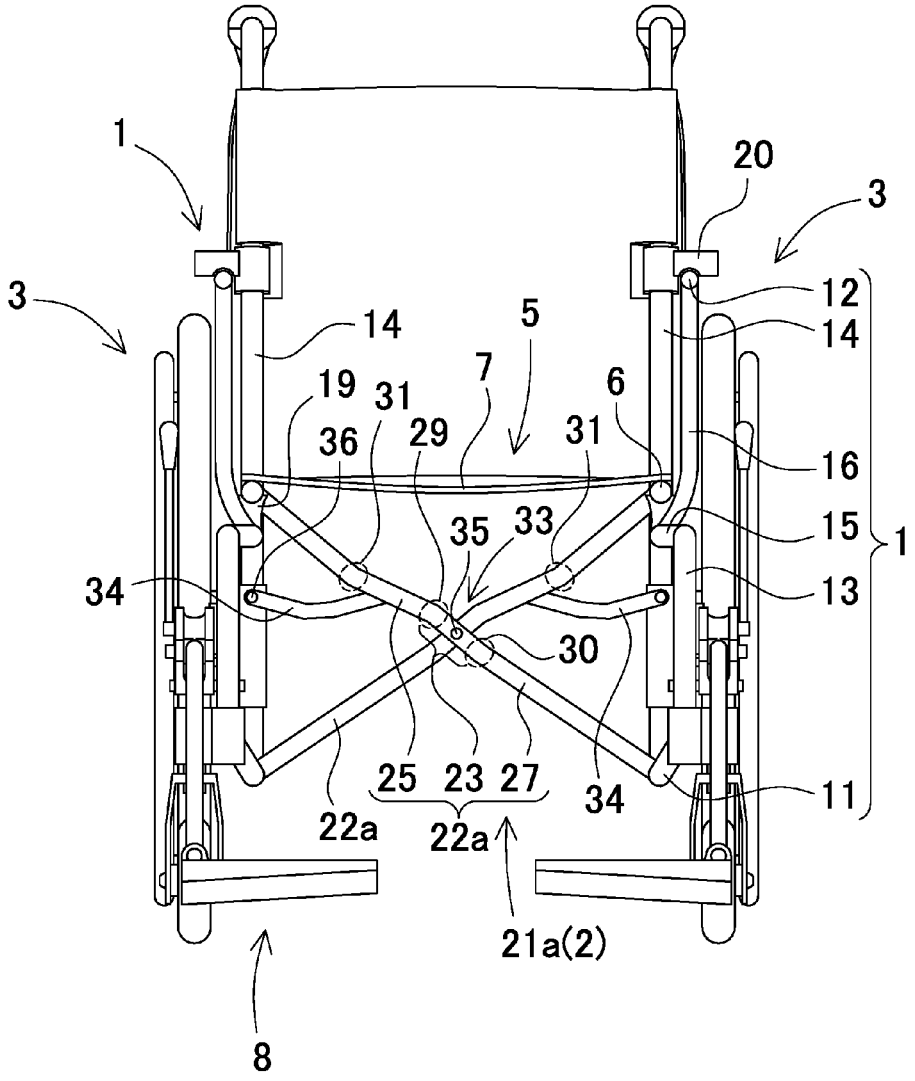
FIG. 5 is a front view of a wheelchair according to another embodiment of the present invention.
Figure 6:
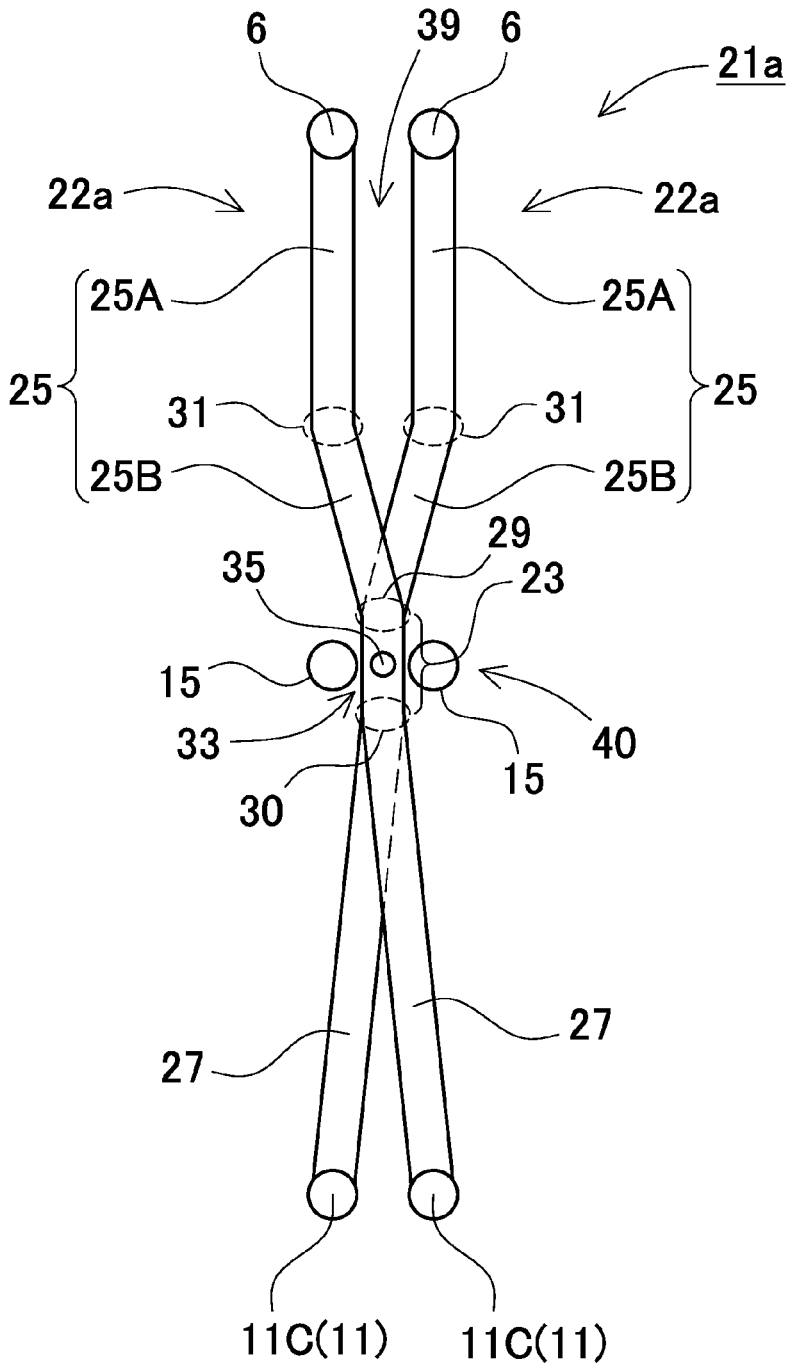
FIG. 6 is a front view of an X-link portion of the wheelchair shown in FIG. 5.

FIG. 5 is a front view of a wheelchair according to the second embodiment of the present invention. FIG. 6 is a front view of a folded X-link portion 21*a* of the wheelchair shown in FIG. 5. The X-link portion 21*a* of the illustrated wheelchair includes link rods 22*a* each of which has a third inclined part 31 in addition to the first and second inclined parts 29 and 30 of the link rod 22 of the wheelchair which are described in the first embodiment. The third inclined part 31 is arranged in the rod upper part 25.

In the wheelchair shown in FIG. 5, although the rod upper part 25 of the X-link portion 21*a* has an inclined part, the interval between the seat frames 6, which are coupled to the upper ends of the rod upper parts 25, can be dimensioned similar to the wheelchair according to the first embodiment. That is, the width of the wheelchair and the size of the seat space 7 can be dimensioned similar to the first embodiment.

The rod upper part 25 of the link rod 22*a* shown in FIG. 6 includes an upper-side extension section 25A, and an upper-side transition section 25B. The upper-side extension section 25A extends in the vertical direction when the wheelchair is folded. The upper end of the upper-side extension section 25A is coupled to the seat frame 6. The upper-side transition section 25B extends between the upper-side extension part 25A and the rod central part 23. The upper-side transition section 25B is inclined from the upper end of the rod central part 23 so that its upper end is positioned on the exterior side with respect to its lower end when the wheelchair is folded. The upper-side extension section 25A slants from the third inclined part 31, which is arranged in the transition part between the upper-side transition section 25B and the upper-side extension section 25A, so that the upper-side extension section 25A extends substantially parallel to the rod central part 23. When the X-link portion 21*a* is folded, the upper-side extension sections 25A face each other and extend parallel to each other in the vertical direction.

(Sheet Accommodation Space 39)

The X-link portion 21*a* provides sheet accommodation space 39 which is located above the rod central parts 23 of the link rods 22*a*, and can accommodate the loosened seat sheet 7. The illustrated sheet accommodation space 39 can be defined by the rod upper parts 25 which have the third inclined parts, on other words, by the upper-side extension sections 25A and the upper-side transition sections 25B. As shown in FIG. 6, when the X-link portion 21 is folded, the upper-side extension sections 25A, which face each other, extend substantially parallel to each other so that the sheet accommodation space 39 can be provided which has a predetermined spacing capable of accommodating the loosened seat sheet 7. According to this wheelchair, since the sheet accommodation space 39 is provided, the seat sheet 7 does not interfere with the folding motion of the X-link portion 21*a* when the X-link portion 21*a* is folded. As a result the wheelchair can be compactly folded.

In this X-link portion 21*a*, since the upper-side extension sections 25A face each other and extend parallel to each other when the X-link portion 21*a* is folded, the width of the folded wheelchair can be small but the sheet accommodation space 39 can be surely provided.

However, the upper-side extension sections 25A do not necessarily extend parallel to each other when facing each other. The upper-side extension sections 25A may slant relative to each other so that the distance between them becomes gradually wider toward their top ends. In this case, the sheet accommodation space 39 can become wider toward the top side. Also, the upper-side extension sections 25A may slant relative to each other so that the distance between them becomes gradually narrower toward their top ends. In this case, the distance between the seat frames 6, which are coupled to the upper ends of the upper-side extension sections 25A, can be narrower.

In the link rods 22*a* shown in FIGS. 5 and 6, although the upper-side transition section 25B of the link rod 22*a* has a straight shape, the upper-side transition sections 25B may be curved toward the exterior side. In this case, the area of the sheet accommodation space 39 can be large.

The wheelchair of the second embodiment has been described. In the wheelchair according to the second embodiment, the rod upper part 25 of the link rod 22*a* has the inclined part. In the wheelchair according to the present invention, the rod lower part of the link rod can have an inclined part as well as the rod upper part 25 of the second embodiment. The following description will describe a wheelchair according to a third embodiment including link rods each of which includes a rod lower part having an inclined part.

Third Embodiment

Figure 7:
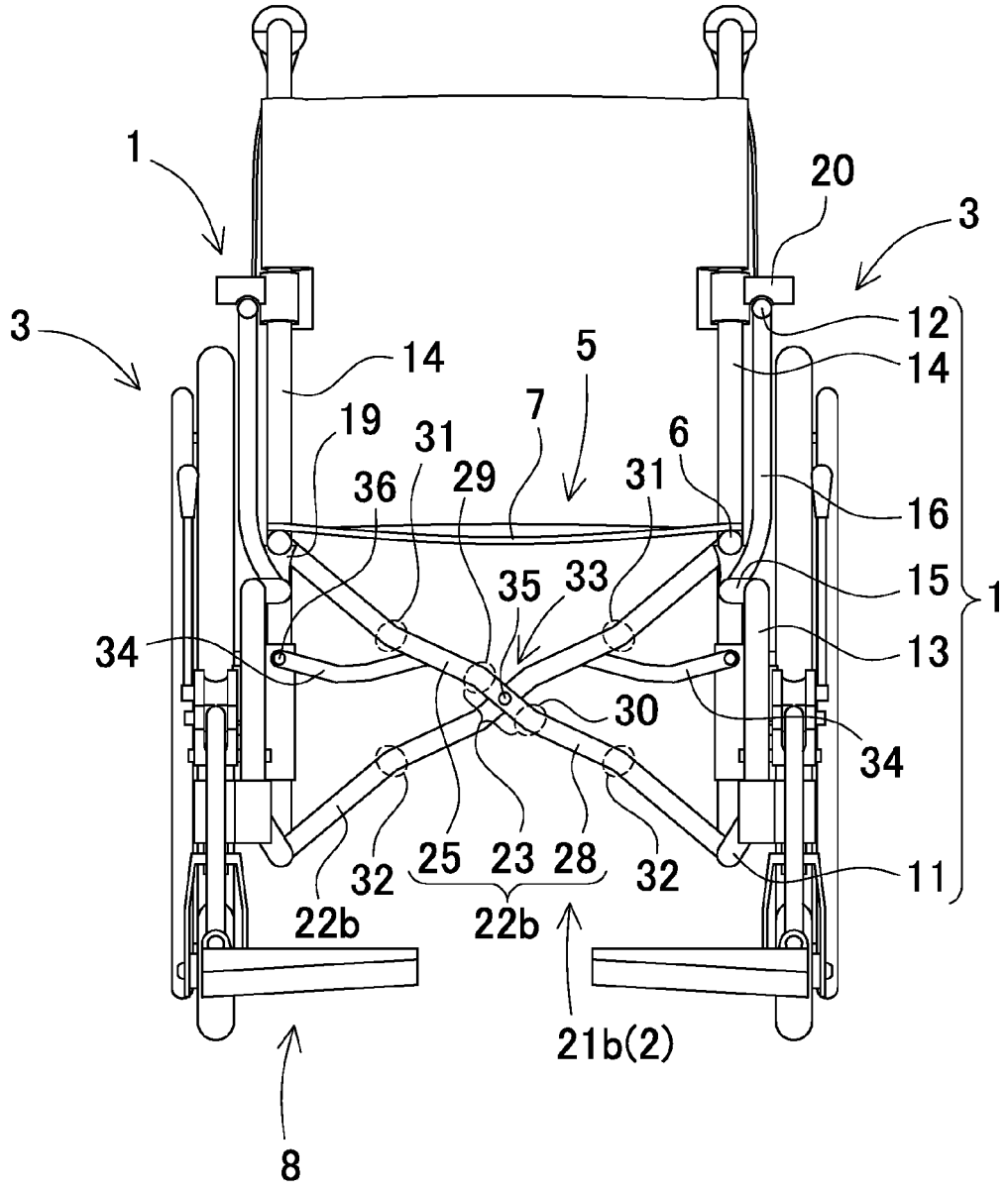
FIG. 7 is a front view of a wheelchair according to another embodiment of the present invention.
Figure 8:
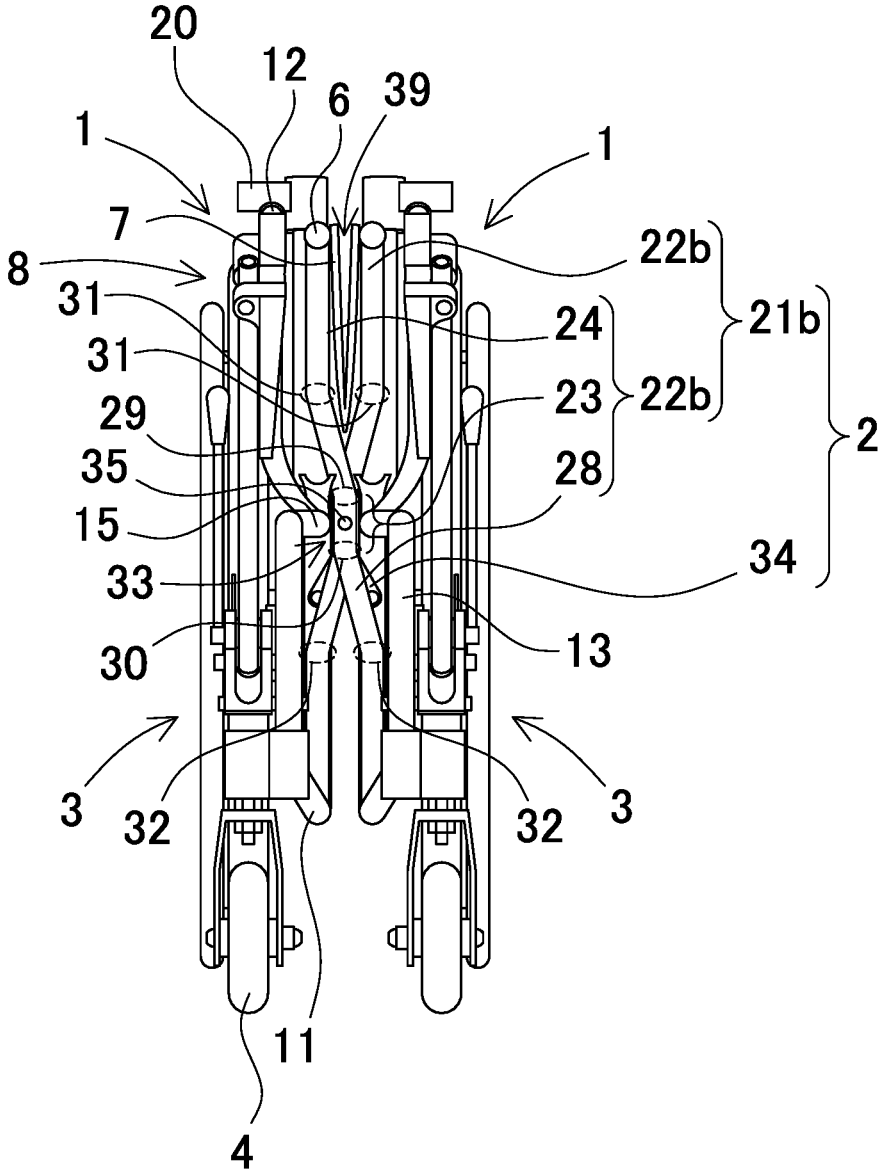
FIG. 8 is a front view showing the wheelchair shown in FIG. 7 when folded.
Figure 9:
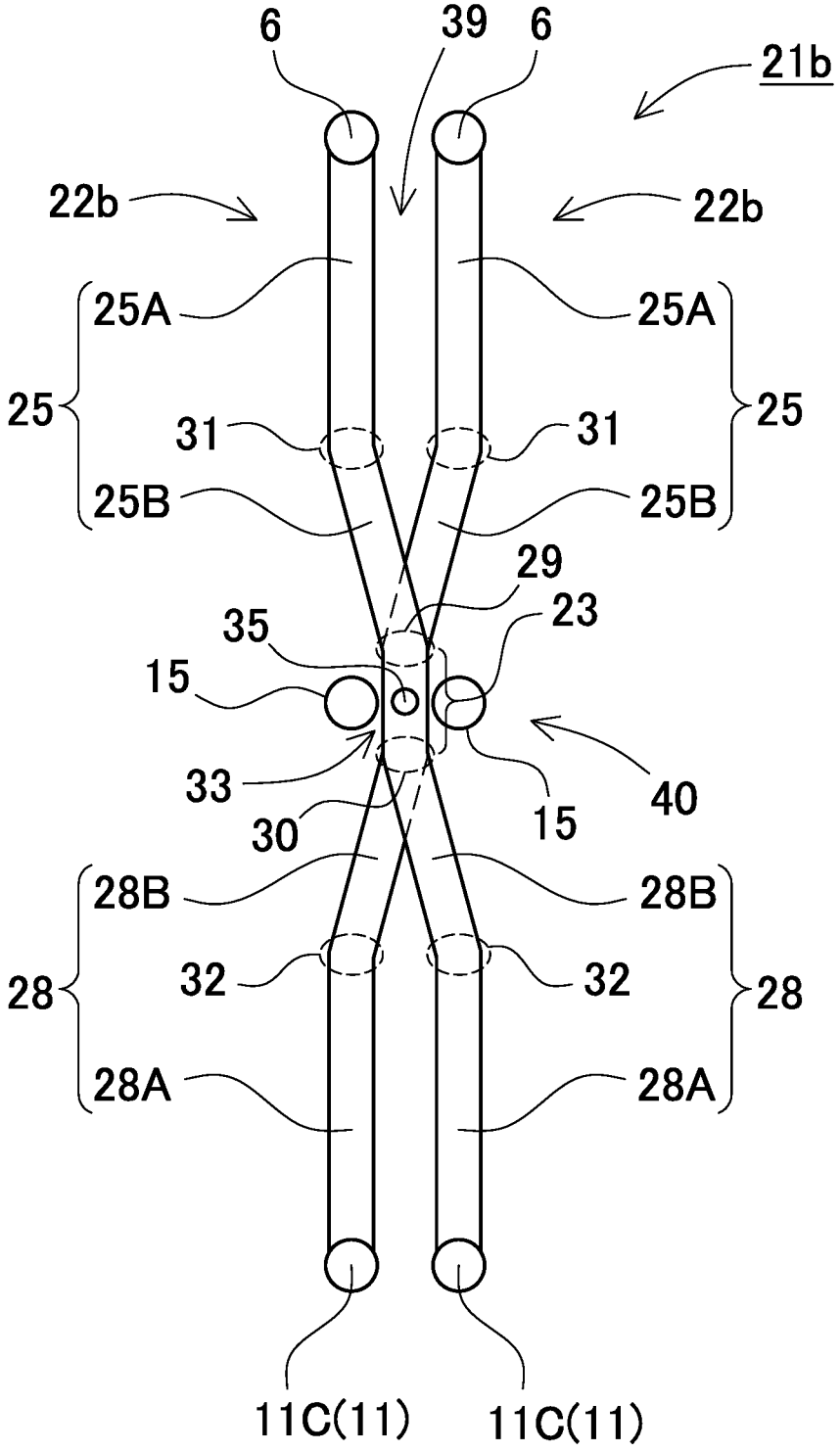
FIG. 9 is a front view of an X-link portion of the wheelchair shown in FIG. 7.
Figure 10:
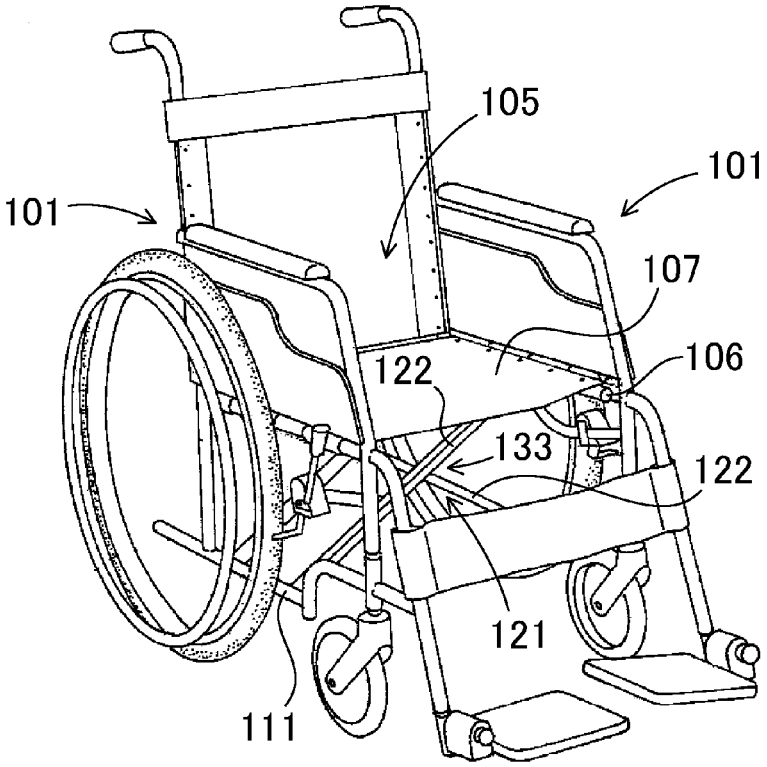
FIG. 10 PRIOR ART
FIG. 10 is a perspective view showing a conventional wheelchair.

FIG. 7 is a front view showing a wheelchair according to a third embodiment. FIG. 8 is a front view showing the folded wheelchair shown in FIG. 7. FIG. 9 is a front view a folded X-link portion 21*b* of the wheelchair shown in FIG. 7. The illustrated X-link portion 21*b* includes link rods 22*b* each of which includes a fourth inclined part 32 in addition to the first, second and third inclined parts 29, 30 and 31 which are described in the second embodiment. The fourth inclined part 32 is arranged in the rod lower part 28.

In the wheelchair shown in FIG. 7, although the rod lower part 28 of the X-link portion 21*b* has an inclined part, the interval between the bottom frame portions which are coupled to the lower ends of the rods 28, can be dimensioned similar to the wheelchair according to the first and second embodiments. That is, the width of the wheelchair and the size of the seat space 7 can be dimensioned similar to the first and second embodiments.

In the X-link portion 21*b* of the wheelchair according to the third embodiment, the sheet accommodation space 39 can be provided between the rod upper parts 25 which face each other when the X-link portion 21*b* is folded similar to the X-link portion 21*a* of the wheelchair according to the second embodiment. When the wheelchair is folded by moving the side frames 1 toward each other as shown in FIG. 8, the loosened seat sheet 7 can be accommodated in the sheet accommodation space 39 which is provided between the rod upper parts 25.

The rod lower part 28 of the link rod 22*b* shown in FIG. 9 includes a lower-side extension section 28A, and a lower-side transition section 28B. The lower-side extension section 28A extends in the vertical direction when the wheelchair is folded. The lower end of the lower-side extension section 28A is coupled to the bottom frame portion 11. The lower-side transition section 28B extends between the lower-side extension part 28A and the rod central part 23. The lower-side transition section 28B slants toward the exterior side of the wheelchair from the second inclined part 30, which is arranged in the transition part between the rod central part 23 and the lower-side transition section 28B, so that the lower end of the lower-side transition section 28B is positioned on the exterior side relative to the upper end of the lower-side transition section 28B when the X-link portion 21*b* is folded. The lower-side extension section 28A slants from the fourth inclined part 32, which is arranged in the transition part between the lowe-side transition section 28B and the lower-side extension section 28A, so that the lower-side extension section 28A extends substantially parallel to the rod central part 23. When the X-link portion 21*b* is folded, the lower-side extension sections 28A face each other and extend parallel to each other in the vertical position.

According to this wheelchair, when the X-link portion 21*b* is folded so that the side frames 1 are positioned close to each other, the lower-side extension sections 28A of the rod lower part 28 can be brought in the vertical position and positioned close to each other. According to this arrangement, since the lower-side extension sections 28A of the link rods 22*b* can vertically extend, loads that are applied to the link rods 22*b* can be applied vertically downward to the bottom frame portions 11. For this reason, when the wheelchair is folded, the bottom frame portions 11 can surely support the loads from the X-link portion 21*b*, and can avoid moving the side frames 1 toward the exterior sides due to the weight of the X-link portion 21*b*. As a result, the wheelchair can be stably held folded.

According to a wheelchair of the present invention, middle frame portions can be accommodated in frame accommodation space portions when the wheelchair is folded by moving side frames toward each other. Therefore, when the wheelchair is folded, the distance between the middle frame portions can be reduced so that the width of the folded wheelchair can be small.

It should be apparent to those with an ordinary skill in the art that while various preferred embodiments of the invention have been shown and described, it is contemplated that the invention is not limited to the particular embodiments disclosed, which are deemed to be merely illustrative of the inventive concepts and should not be interpreted as limiting the scope of the invention, and which are suitable for all modifications and changes falling within the scope of the invention as defined in the appended claims.

What is claimed is:

1. A wheelchair comprising:

driving wheels;

a pair of side frames that rotatably support said driving wheels coupled to the exterior sides of the side frames;

a folding linkage that foldably interlinks said side frames with each other so that the wheelchair can be folded by moving said side frames toward each other;

a pair of seat frames that are coupled to the upper ends of said folding linkage; and a flexible seat sheet that has sides coupled to said seat frames;

wherein said folding linkage includes a pair of link rods that intersect each other in an X shape thereby forming an X-link portion, and are pivotably coupled to each other by a pivot shaft, wherein each of said side frames includes a bottom frame portion that extends in the horizontal direction, and swingably supports said link rod about the lower end of said link rod coupled to the bottom frame portion, and a middle frame portion that is arranged above said bottom frame portion parallel to the bottom frame portion, wherein each of said link rods includes a rod central part that holds said pivot shaft, and rod upper and lower parts that extend from first and second inclined parts on the both ends of said rod central part, and slant from the first and second inclined parts in opposite directions with respect to said rod central part, wherein the upper end of said rod upper part is coupled to said seat frame, wherein the lower end of said rod lower part is coupled to said bottom frame portion, and said bottom frame portion swingably supports said link rod, wherein, when said X-link portion is folded, the rod central parts overlap each other and are aligned in one straight line in the vertical orientation, and frame accommodation space portions which can accommodate said middle frame portions are provided on the both sides of the rod central parts in the vertical position and between the rod upper and lower parts, which slant in opposite directions with respect to said rod central parts, wherein said rod upper part includes an upper-side extension section that has an upper end coupled to said seat frame, and an upper-side transition section that extends between the upper-side extension section and the upper end of said rod central part, wherein said upper-side transition section slants toward the exterior side of the wheelchair from said first inclined part, which is arranged in a transition part between said rod central part and said upper-side transition section, so that the upper end of said upper-side transition section is positioned on the exterior side relative to the lower end of said upper-side transition section when said X-link portion is folded, wherein said upper-side extension section slants from a third inclined part which is arranged in a transition part between said upper-side transition section and said upper-side extension section so that said upper-side extension section extends substantially parallel to said rod central part, and wherein sheet accommodation space, which can accommodate said seat sheet in a loose state, is provided between said upper-side extension sections that face each other when said X-link portion is folded.

2. The wheelchair according to claim 1, wherein when said X-link portion is folded, said upper-side extension sections face each other and extend parallel to each other in the vertical direction, and said sheet accommodation space is provided between said link rods.

3. A wheelchair comprising:

driving wheels;

a pair of side frames that rotatably support said driving wheels coupled to the exterior sides of the side frames;

a folding linkage that foldably interlinks said side frames with each other so that the wheelchair can be folded by moving said side frames toward each other;

a pair of seat frames that are coupled to the upper ends of said folding linkage; and a flexible seat sheet that has sides coupled to said seat frames;

wherein said folding linkage includes a pair of link rods that intersect each other in an X shape whereby forming an X-link portion, and are pivotably coupled to each other by a pivot shaft, wherein each of said side frames includes a bottom frame portion that extends in the horizontal direction, and swingably supports said link rod about the lower end of said link rod coupled to the bottom frame portion, and a middle frame portion that is arranged above said bottom frame portion parallel to the bottom frame portion, wherein each of said link rods includes a rod central part that holds said pivot shaft, and rod upper and lower parts that extend from first and second inclined parts on the both ends of said rod central part, and slant from the first and second inclined parts in opposite directions with respect to said rod central part, wherein the upper end of said rod upper part is coupled to said seat frame, wherein the lower end of said rod lower part is coupled to said bottom frame portion, and said bottom frame portion swingably supports said link rod, and wherein, when said X-link portion is folded, the rod central parts overlap each other and are aligned in one straight line in the vertical orientation, and frame accommodation space portions, which can accommodate said middle frame portions, are provided on both sides of the rod central parts in the vertical position and between the rod upper and lower parts, which slant in opposite directions with respect to said rod central parts, wherein said rod lower part has a straight shape, and slants toward the exterior side of the wheelchair from said second inclined part, which is arranged in a transition part between said rod central part and said rod lower part, so that the lower end of said rod lower part is positioned on the exterior side relative to the upper end of said rod lower part when said X-link portion is folded.

4. A wheelchair comprising:

driving wheels;

a pair of side frames that rotatably support said driving wheels coupled to the exterior sides of the side frames;

a folding linkage that foldably interlinks said side frames with each other so that the wheelchair can be folded by moving said side frames toward each other;

a pair of seat frames that are coupled to the upper ends of said folding linkage; and a flexible seat sheet that has sides coupled to said seat frames;

wherein said folding linkage includes a pair of link rods that intersect each other in an X shape whereby forming an X-link portion, and are pivotably coupled to each other by a pivot shaft, wherein each of said side frames includes a bottom frame portion that extends in the horizontal direction, and swingably supports said link rod about the lower end of said link rod coupled to the bottom frame portion, and a middle frame portion that is arranged above said bottom frame portion parallel to the bottom frame portion, wherein each of said link rods includes a rod central part that holds said pivot shaft, and rod upper and lower parts that extend from first and second inclined parts on the both ends of said rod central part, and slant from the first and second inclined parts in opposite directions with respect to said rod central part, wherein the upper end of said rod upper part is coupled to said seat frame, wherein the lower end of said rod lower part is coupled to said bottom frame portion, and said bottom frame portion swingably supports said link rod, wherein, when said X-link portion is folded, the rod central parts overlap each other and are aligned in one straight line in the vertical orientation, and frame accommodation space portions, which can accommodate said middle frame portions, are provided on both sides of the rod central parts in the vertical position and between the rod upper and lower parts, which slant in opposite directions with respect to said rod central parts, wherein said rod lower part includes a lower-side extension section that has a lower end coupled to said bottom frame portion, and a lower-side transition section that extends between said lower-side extension section and the lower end of said rod central part, wherein said lower-side transition section slants toward the exterior side of the wheelchair from said second inclined part, which is arranged in the transition part between said rod central part and said lower-side transition section, so that the lower end of said lower-side transition section is positioned on the exterior side relative to the upper end of said lower-side transition section when said X-link portion is folded, wherein said lower-side extension section slants from a fourth inclined part, which is arranged in the transition part between said lower-side transition section and said lower-side extension section so that said lower-side extension section extends substantially parallel to said rod central part, and wherein said lower side extension portions face each other and extend parallel to each other in the vertical direction when said X-link portion is folded.

* * * * *